US006540475B2

(12) United States Patent
Conrad et al.

(10) Patent No.: US 6,540,475 B2
(45) Date of Patent: Apr. 1, 2003

(54) GAS FRICTION PUMP

(75) Inventors: Armin Conrad, Herborn (DE); Peter Fahrenbach, Braunfels (DE)

(73) Assignee: Pfeiffer Vacuum GmbH, Asslar (DE)

( * ) Notice: Subject to any disclaimer, the term of this patent is extended or adjusted under 35 U.S.C. 154(b) by 0 days.

(21) Appl. No.: 09/855,074

(22) Filed: May 14, 2001

(65) Prior Publication Data

US 2001/0041133 A1 Nov. 15, 2001

(30) Foreign Application Priority Data

May 15, 2000 (DE) ..... 100 23 799

(51) Int. Cl.[7] ..... F04D 19/04
(52) U.S. Cl. ..... 415/90; 415/143
(58) Field of Search ..... 415/90, 143; 417/423.4

(56) References Cited

U.S. PATENT DOCUMENTS 3,969,039 A * 7/1976 Shoulders ..... 415/90
4,830,584 A * 5/1989 Mohn ..... 415/143
5,165,872 A 11/1992 Flieschmann et al.
5,553,998 A 9/1996 Muhloff et al.
5,577,883 A 11/1996 Schutz et al.
5,611,660 A * 3/1997 Wong et al. ..... 415/90
5,664,935 A * 9/1997 Nishiuchi et al. ..... 415/143
5,927,940 A 7/1999 Lotz et al.
6,106,223 A * 8/2000 Leyshon ..... 415/116
6,193,461 B1 * 2/2001 Hablanian ..... 415/143

FOREIGN PATENT DOCUMENTS

DE 2757599 6/1979
DE 4227663 2/1994

OTHER PUBLICATIONS

European Search Report.

* cited by examiner

*Primary Examiner*—Edward K. Look
*Assistant Examiner*—Igor Kershteyn
(74) *Attorney, Agent, or Firm*—Sidley Austin Brown & Wood, LLP

(57) ABSTRACT

A gas friction pump including a plurality of pumping active rotor and stator components arranged in the pump housing for delivery of gases and for producing a compression ration and having a diameter larger than a diameter of the suction opening formed in the housing, and a modified rotor component located adjacent to the suction opening and having a radial extent which increases starting from the suction opening in a direction of a radial extent of the pumping active rotor and stator components.

8 Claims, 5 Drawing Sheets

GAS FRICTION PUMP

BACKGROUND OF THE INVENTION

1. Field of the Invention

The present invention relates to a gas friction pump including a housing having a suction opening connectable with a recipient, and a gas outlet opening, and a plurality of pumping active rotor and stator components arranged in the housing for delivery of gases and for producing a compression ratio, with the rotor and stator components having a diameter larger than a diameter of the suction opening.

2. Description of the Prior Art

For delivery of gases, gas friction pumps of different types are used. The gas friction pump operates in a molecular flow region, and its operation is based on transmission of pulses of movable walls to gas particles. A first gas friction pump of this type was developed by German scientist and engineer Gaede. The gas friction pump was further modified, without altering its basic principle, by German engineers Siegbahn, Holweck, and Becker. The latest modification is known as a turbomolecular pump. The turbomolecular pump found a wide application in science and industry, and the present invention is described with reference to a turbomolecular pump.

The below described drawbacks of the conventional turbomolecular pumps and elimination of these drawbacks by the present invention are equally applicable to other types of gas friction pumps.

The suction capacity of the turbomolecular pumps is determined, in addition to their inner structure and the rotational speed, by the inlet cross-section of the suction flange. The dimensions of the suction flange, in accordance with existing standards, is established at a somewhat smaller value. If with so predetermined suction cross-section, a larger suction capacity need be achieved, the diameter of the stator and rotor discs and, thus, the pumping active surface can be increased. This results in a structure in which the rotor and stator disc diameter is larger than the diameter of the suction flange. It is obvious that the suction capacity is limited by the cross-section of the suction flange. The reduced cross-section of the suction flange finctions as flow resistance between the uppermost rotor disc and the recipient.

Accordingly, the object of the present invention is to provide means that would permit to overcome this flow resistance to a most possible extent in order to be able to use the suction capacity, which is predetermined by the upper rotor disc, to a maximum.

SUMMARY OF THE INVENTION

This and other object of the present invention, which will become apparent hereinafter, are achieved by providing a modified rotor component located adjacent to the suction opening and having a gas delivery structure. The modified rotor component has a radial extent which increases starting from the suction opening in a direction of a radial extent of the pumping active rotor and stator components and which can attain the radial extent of the pumping active rotor and stator components.

The modified rotor component permits to reduce the conductance losses, which are caused by the reduced predetermined diameter of the suction flange, to a most possible extent. The pumped-out gas is fed from the recipient through the gas delivery structure of the conventional, large diameter rotor and stator components further without any losses.

By selecting an appropriate profile of the modified rotor component stepped, conical, dome-shaped, etc . . . , the modified rotor component can be optimally adapted to the recipient and to the connection of the recipient with the suction flange. The modified rotor component can be so formed that it would extend through the suction opening and into the recipient.

The present invention contemplates arranging in the pump housing of stator components with pumping active structure opposite the modified rotor component. These stator components permit to effectively form an optimal transition from smaller diameters to larger diameters.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show:

FIG. 4*b* a perspective, partial view of the turbomolecular pump shown in FIG. 4*a.

DETAILED DESCRIPTION OF THE PREFERRED EMBODIMENTS

Figure 1:
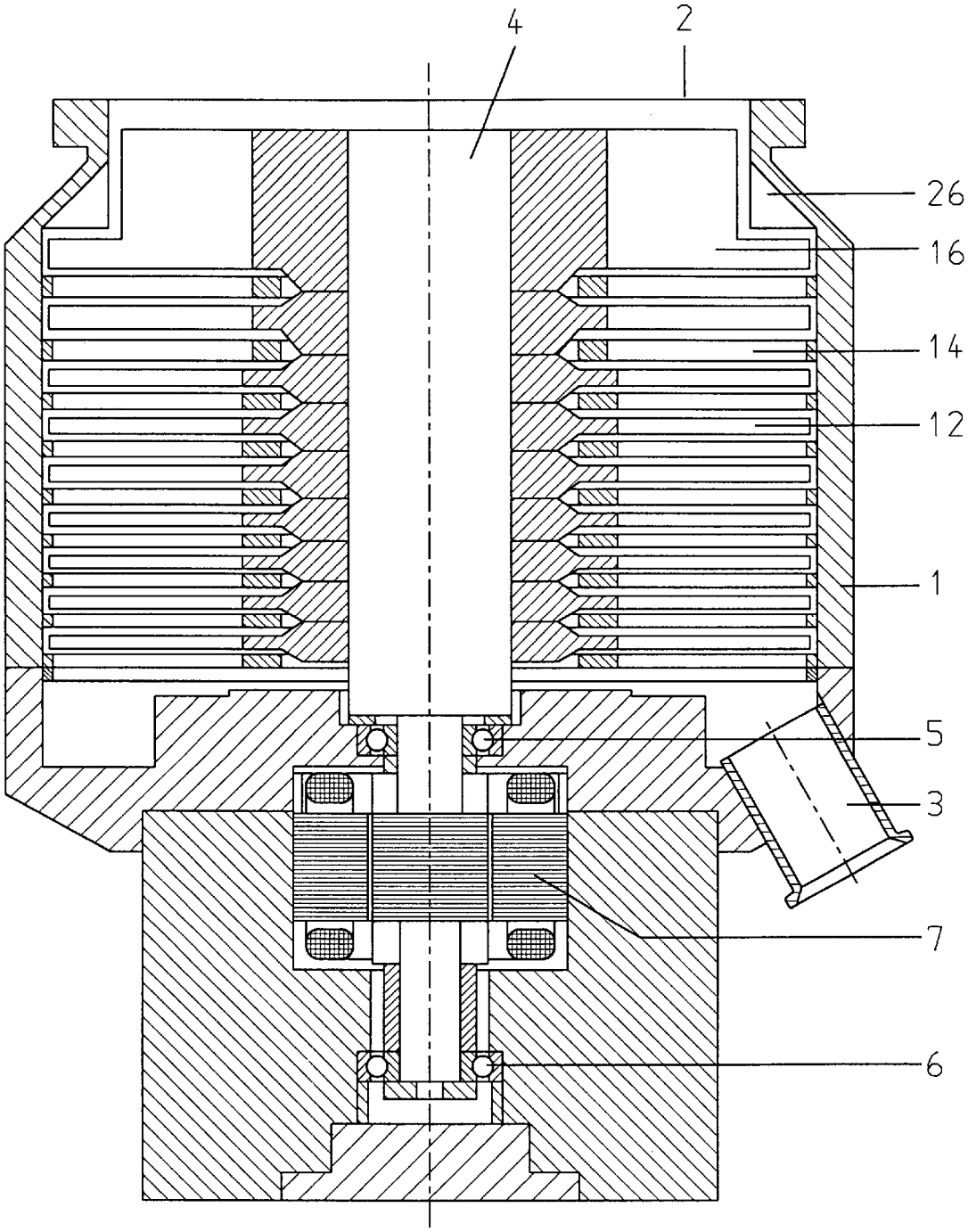
FIG. 1 a cross-section general view of a turbomolecular pump according to the present invention.

A gas fiction pump according to the present invention, which is shown in FIG. 1, has a housing 1 provided with a suction opening 2, which is connected with a recipient, and a gas outlet opening 3. The pump rotor shaft 4 is supported in bearings 5 and 6 and is driven by a motor 7. A plurality of rotor components 12 are secured on the rotor shaft 4. The rotor components 12 are provided with an active pumping structure and cooperate with respective stator components 14, which are likewise provided with an active pumping structure, for producing a pumping effect. The suction opening 2 has an inner diameter which is smaller than an outer diameter of the rotor and stator components 12 and 14.

Figure 2A:
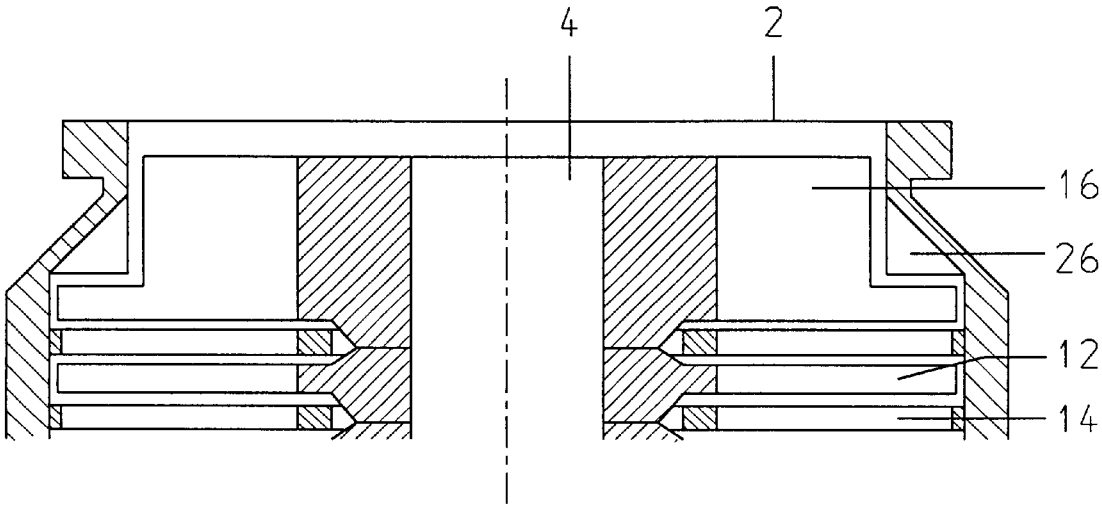
FIG. 2*a* a cross-sectional, partial view of a first embodiment of a turbomolecular pump according to the present invention.
Figure 2B:
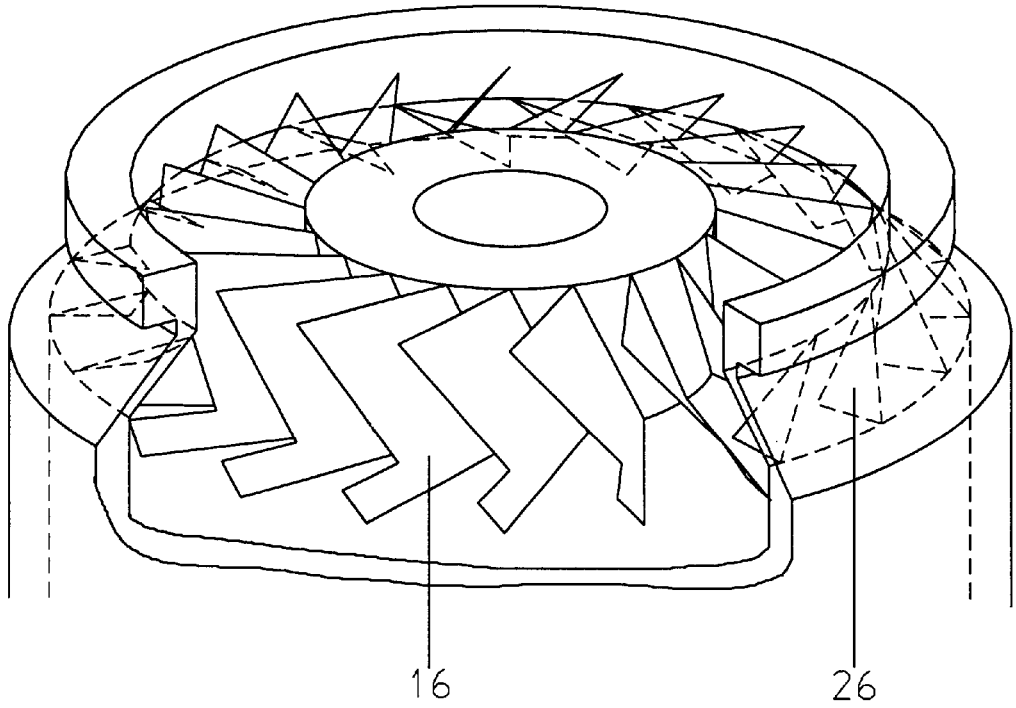
FIG. 2*b* a perspective, partial view of the turbomolecular pump shown in FIG. 2*a;*
Figure 3A:
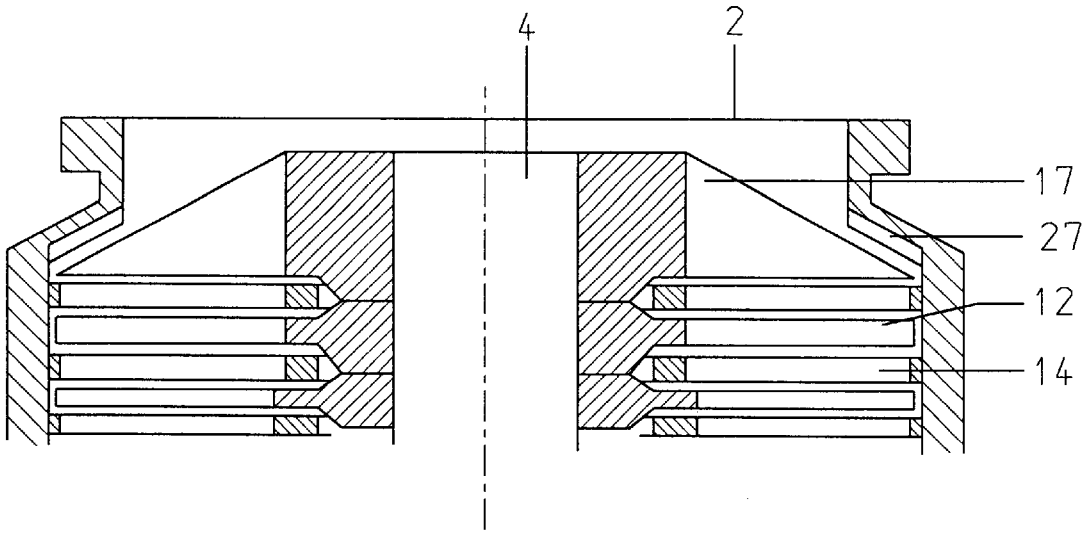
FIG. 3*a* a cross-sectional, partial view of a second embodiment of a turbomolecular pump according to the present invention.
Figure 3B:
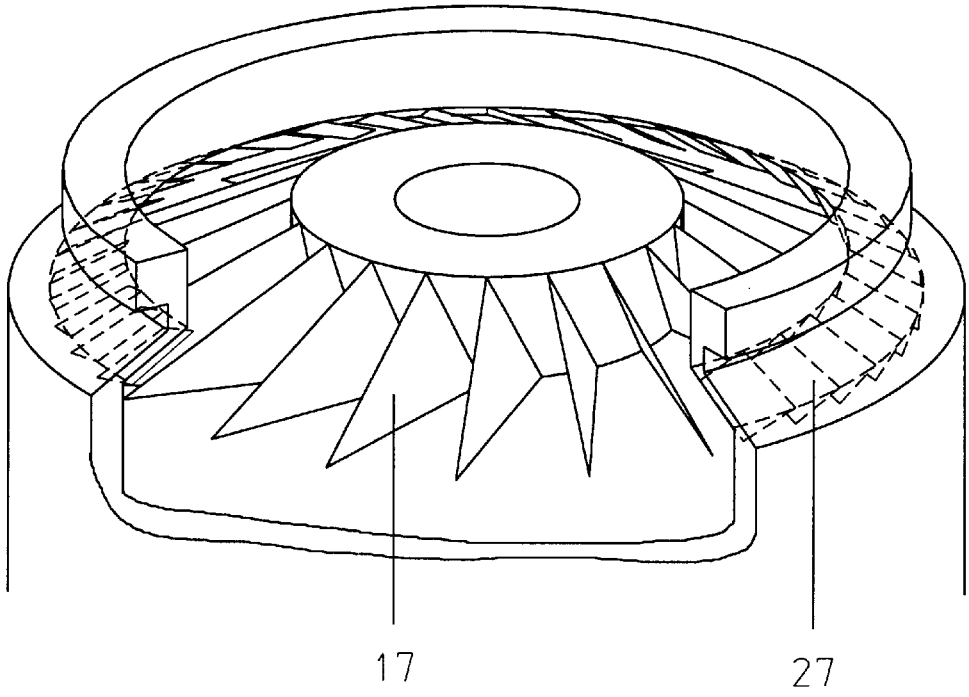
FIG. 3*b* a perspective, partial view of the turbomolecular pump shown in FIG. 3*a;*
Figure 4A:
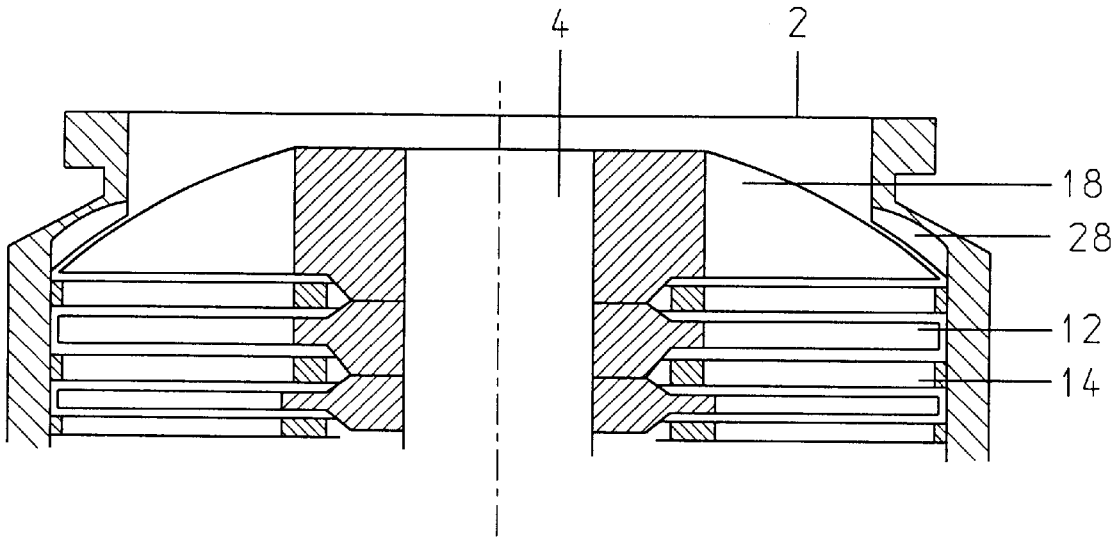
FIG. 4*a* a cross-sectional, partial view of a third embodiment of a turbomolecular pump according to the present invention.
Figure 4B:
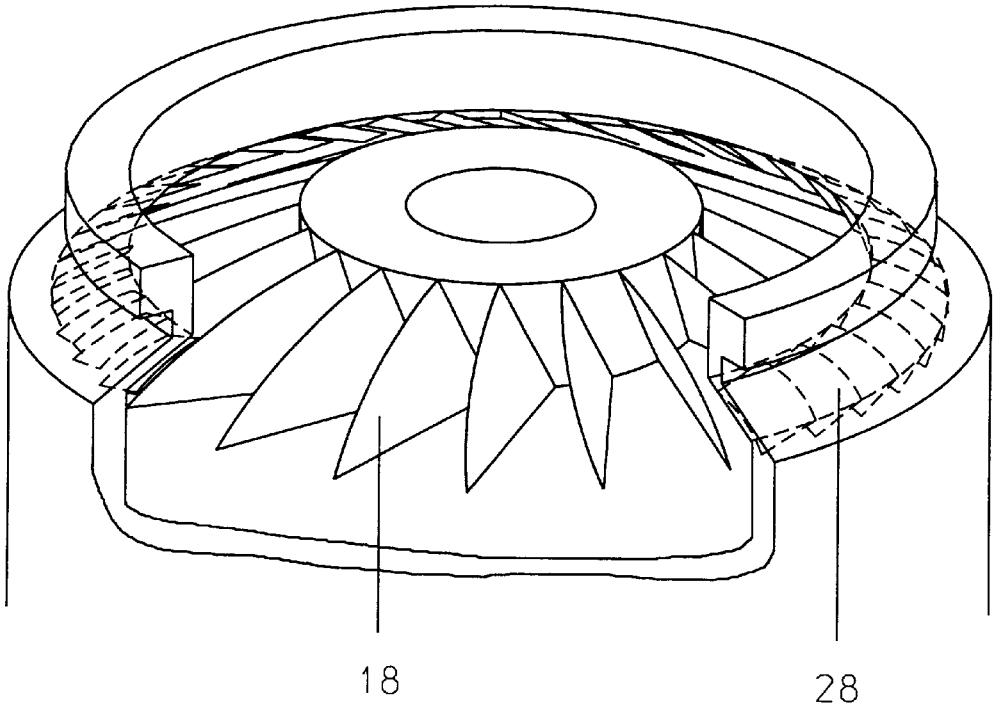
Figure 5:
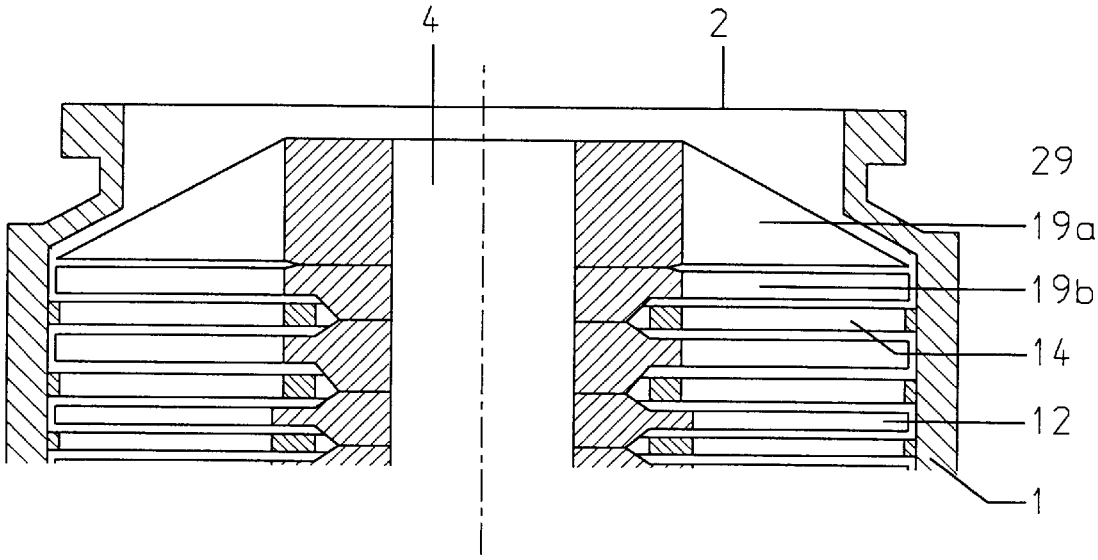
* and FIG. 5 a cross-sectional fourth view of a embodiment turbomolecular pump according to the present invention.

According to the present invention, adjacent to the suction opening 2, there is provided a modified rotor component 16, a perspective view of which is shown in FIG. 2*b,* FIG. 2*a* showing a cross-sectional view of the rotor component 16. The rotor component 16 is provided with a gas delivery structure. The radial extent of the rotor component 16 increases from the suction opening 2 in a direction of the radial extent of other rotor and stator components, and the radial extent of the modified rotor component 16 can reach that of other rotor and stator components. In different embodiments, the modified rotor component 16 can have different shapes along its radial extent. In the embodiments of FIGS. 1, 2*a,* and 2*b,* the modified rotor component 16 has a stepped profile. In the embodiment shown in FIGS. 3*a*–3*b,* the modified rotor component 17 has a continuous conical profile. In the embodiment shown in FIGS. 4*a*–4*b,* the modified rotor component 18 has a dome-shaped profile. It is also possible to form the modified rotor component with a combination profile. The modified rotor components can be formed of several sections, e.g., of sections 19*a,* 19*b* as shown in FIG. 5. This may be beneficial from the manufacturing point of view.

It is also possible to so form the modified rotor component that its radial extent will be smaller than that of remaining components, with the axial extent being unchanged.

Stator components 26–29 with a pumping active structure can be arranged opposite respective modified rotor components 16–19, as shown in FIGS. 1–5. The stator components 26–29 can be formed as separate components (FIGS. 1–4*b*) or as a portion of the housing 1 (FIG. 5).

Though the present invention was shown and described with references to the preferred embodiments, such as merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A gas friction pump, comprising a housing having a suction opening connectable with a recipient, and a gas outlet opening; a plurality of pumping active rotor and stator components arranged in the housing for delivery of gases and for producing a compression ratio, the rotor and stator components having a diameter larger than a diameter of the suction opening; and a modified rotor component located adjacent to the suction opening and having a gas delivery structure, the modified rotor component having a radial extent which increases starting from the suction opening in a direction of a radial extent of the pumping active rotor and stator components.

2. A gas friction pump as set forth in claim 1, wherein the radial extent of the modified rotor component increases in a stepped-like manner.

3. A gas friction pump as set forth in claim 1, wherein the radial extent of the modified rotor component increases continuously.

4. A gas friction pump as set forth in claim 1, wherein the modified rotor component has, at least partially a conical profile.

5. A gas friction pump as set forth in claim 1, wherein the modified rotor component has, at least partially, a dome-shaped profile.

6. A gas friction pump as set forth in claim 1, wherein the radial extent of the modified rotor component corresponds, at a side thereof adjacent to a stator component, to the radial extent of the pumping active rotor and stator components.

7. A gas friction pump as set froth in claim 1, wherein the modified rotor component projects through the suction opening.

8. A gas friction pump as set forth in claim 1, wherein the modified rotor component is formed of separate sections.

* * * * *